United States Patent [19]

Kizziah

[11] 4,424,678

[45] Jan. 10, 1984

[54] HEAT POWERED APPARATUS

[76] Inventor: Terrel A. Kizziah, Rte. 1, Box 71, Vance, Ala. 35490

[21] Appl. No.: 306,178

[22] Filed: Sep. 28, 1981

[51] Int. Cl.[3] ..... F01K 27/00

[52] U.S. Cl. ..... 60/670; 60/516; 60/721; 60/671

[58] Field of Search ..... 60/516, 670, 671, 721, 60/651

[56] References Cited

U.S. PATENT DOCUMENTS

| | | | |
|---|---|---|---|
| 3,531,933 | 10/1970 | Baldwin | 60/671 |
| 3,695,036 | 10/1972 | Martin | 60/671 |
| 3,846,984 | 11/1974 | Siegel | 60/509 |
| 3,932,995 | 1/1976 | Pecar | 60/676 X |
| 4,006,595 | 2/1977 | Forbes | 60/651 |

*Primary Examiner*—Allen M. Ostrager
*Attorney, Agent, or Firm*—Jones & Askew

[57] ABSTRACT

Apparatus for producing useful work from available heat at super-ambient temperature. The present apparatus includes a pair of working fluid units which supply pressurized vapor to a utilization apparatus. Each working fluid unit includes a generator for boiling the working fluid in response to available heat, and a recovery vessel for receiving condensed working fluid exhausted from the utilization apparatus after expansion to produce useful work. The condensed working fluid from the utilization apparatus is alternatively returned to the recovery vessel associated with the generator presently receiving heat to generate pressurized vapor.

8 Claims, 1 Drawing Figure

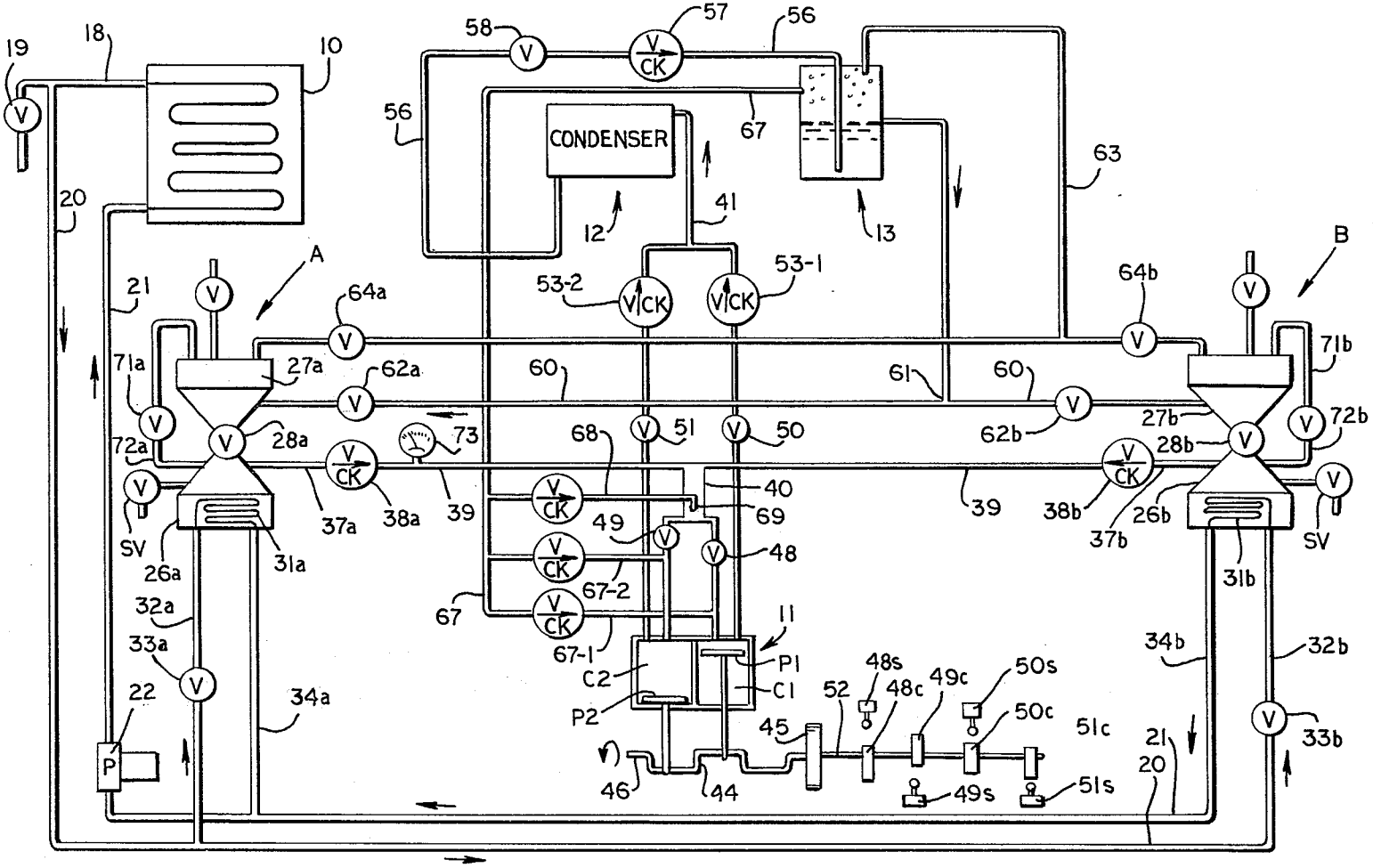
CONDENSER
A
B
P
SV

HEAT POWERED APPARATUS

FIELD OF INVENTION

This invention relates in general to heat powered machines and the like, and relates in particular to apparatus for performing useful work by extracting energy from an available heat source presenting a temperature differential relative to ambient temperature.

BACKGROUND OF THE INVENTION

The increasing cost of fossil fuels and other energy sources has motivated the search for ways to utilize more fully and efficiently our available energy. Various sources of heat have been recognized as sources of potentially-available energy, with some examples of such heat being so-called "waste heat" from various industrial or commerical applications, and various sources of heat found in domestic environments. One example of the latter is the heat in a typical home attic, there the temperature is usually hotter than ambient temperature even when the attic is insulated from the living areas of the building. Solar energy is another example of heat energy available at relatively low operating cost to the user, apart from the capital cost of apparatus for collecting the solar energy.

Although the theoretical availability of the foregoing and similar forms of heat energy is well known to those skilled in the art, apparatus for making use of such heat energy has been complex, expensive, and consequently not practical for many applications where the amount of available heat energy could not justify the capital cost of prior art equipment required to convert the heat energy to mechanical energy.

SUMMARY OF INVENTION

Accordingly, it is an object of the present invention to provide improved apparatus for utilizing heat energy.

It is another object of the present invention to provide apparatus for performing work from available heat energy.

It is yet another object of the present invention to provide relatively inexpensive apparatus for utilizing available heat energy from a temperature source above ambient temperature.

The foregoing and other objects and advantages of the present invention will become apparent from the following discussion.

Stated in general terms, the present invention includes a pair of vapor generating and recovery units containing a working fluid which boils in response to applied available heat to produce pressurized vapor. Work is performed by expanding the pressurized vapor in a suitable utilization apparatus, after which the expanded vapor is recondensed without a compression. The available heat may be attained from any appropriate source such as a solar collector, a heat collector located at a suitable temperature above ambient temperature, or the like.

A transfer medium supplies the heat in sequence to first one and then the other vapor generators, which also receive a quantity of working fluid vaporizable at the temperature of the heated transfer liquid. The expanded vapor exhausted from the device utilization apparatus is condensed and returned to one of a pair of recovery vessels. Each recovery vessel is associated with a corresponding generator, so that the condensed working fluid returns to a recovery vessel associated with the vapor generator presently supplying vaporized working fluid to the utilization means. When sufficient condensed working fluid is collected in a particular recovery vessel, the collected fluid is permitted to flow, preferably by gravity, into the generator associated with the recovery vessel. The heat-containing transfer liquid then is caused to flow in heat transfer relation with this generator, vaporizing the working fluid therein and providing a continuing source of pressurized vapor to drive the utilization means. The vapor exhausted from the utilization apparatus and condensed is now transferred to the recovery vessel associated with the first vapor generator, for collection and subsequent transfer to that generator.

The foregoing operating cycle continues as long as heat energy input is supplied sufficient to reheat the transfer liquid to the temperature required for boiling and revaporizing the working fluid.

BRIEF DESCRIPTION OF DRAWING

The FIGURE is a schematic fluid flow diagram for a disclosed preferred embodiment of the present invention.

DESCRIPTION OF PREFERRED EMBODIMENT

Turning to the FIGURE, the disclosed embodiment includes a heat collector indicated generally at 10, a pair of working fluid units A and B connected to receive heat from the heat collector 10 and utilize the heat to vaporize a working fluid, and a utilization apparatus 11 receiving pressurized working fluid vapor from the working fluid units and expanding that vapor to produce work output. Expanded vapor exhausted from the apparatus 11 is condensed by the condenser 12 and flows to the liquid return tank 13, where the liquified working fluid is returned to either of the working fluid units A and B, in sequence.

The heat collector 10 may be provided by any suitable heat exchanger which, when subjected to a source of heat, transfers part of that heat to a transfer liquid flowing through the collector. For example, the heat collector 10 may be a tube-type heat exchanger located where the existing temperature is at least approximately 30° F. above ambient temperature. One example of such a location is the typical home attic. Alternatively, the heat collector 10 may be a tube sheet or the like associated with a conventional solar collector panel.

Those skilled in the art will understand that the heat collector 10 contains passages through which a transfer liquid, such as water, may be circulated to receive heat applied to the collector. This transfer liquid is supplied to the collector 10 through a return line 21 and the heated transfer liquid exits the collector through the outlet line 18, which is preferably elevated above the inlet line to connectively aid the flow of heated transfer liquid. A conventional air release valve 19 is connected to the outlet line 19 to maintain substantially ambient pressure within the transfer liquid system.

The transfer liquid system includes a high-temperature supply line 20 leading from the outlet line 18 of the heat collector 10, and a low-temperature return line 21 returning the transfer liquid to the heat collector. The terms "high-temperature" and "low-temperature" in the context of the transfer liquid system are relative terms, inasmuch as the temperature of transfer liquid exiting the heat collector 10 through the outlet line 18 may be 120° F. and the temperature of transfer liquid entering the collector from the return line 21 may be 90° F., by way of example. It will become apparent that the foregoing temperatures are by way of example only, and it should also be apparent that a greater temperature differential between the outlet and inlet temperatures may be reflected in increased operating efficiency of the present system. In the present embodiment the preferred transfer liquid is water, and circulation of the transfer liquid within the closed system for the transfer liquid is provided by the pump 22 in the return line 21.

Turning to the working fluid units A and B, these units respectively include a generator 26A, 26B for boiling and vaporizing a working fluid, and a corresponding recovery vessel 27A, 27B, for receiving and collecting condensed working fluid. Each recovery vessel, for example, recovery vessel 27A, is elevated above its corresponding generator 26A, and the transfer to the corresponding generator 26A or 26B of condensed working fluid collected in the recovery vessel 27A or 27B to the corresponding generator 26A or 26B is controlled by the respective solenoid valves 28A, 28B interconnecting the recovery vessel and generator of each working fluid unit. Each working fluid unit A and B may have the appearance of two conical tanks sitting one atop the other, each recovery vessel 27 being above its associated generator 26, with each working fluid unit A and B having the appearance of an hourglass with the corresponding recovery solenoid valve 28A, 28B located at the midpoint of the hourglass.

Contained within each generator 26A and 26B is a heat exchange coil 31A, 31B, respectively, in heat transfer relation with working fluid within the generator. Each heat exchange coil 31A, 31B is selectably connected to the transfer liquid system by the supply line 32A, 32B connected to the high-temperature supply line 20 through the transfer solenoid valve 33A, 33B, and the return lines 34A, 34B connected to the low-temperature return line 21. The transfer solenoid valves 33A and 33B are preferably connected or otherwise operated in sequence, so that the heated transfer liquid from the heat collector 10 flows through only one or the other of heat exchange coils 31A, 31B at the time, possibly with an overlapping internal with both valves 33A and 33B simultaneously open as described below.

Vapor supply lines 37A, 37B are connected to the respective generators 26A, 26B near the top of the generator, so as to provide an exit passage for pressurized vapor within the generator. Each generator 26A and 26B is preferably also equipped with a conventional high-pressure relief safety valve SV. The vapor supply lines 37A and 37B each pass through respective check valves 38A, 38B and connect to the vapor line 39, which leads to the utilization apparatus 11 by way of conduit 40.

The utilization apparatus 11 may be any suitable mechanism for extracting useful work from a pressurized vapor through the process of vapor expansion from a relatively higher inlet pressure, supplied along line 40, to a relatively low-pressure vapor exhaust. This exhausted vapor leaves the utilization apparatus 11 along the vapor line 41 connected to the condenser 12. The utilization apparatus 11 in the disclosed embodiment is a two-cylinder reciprocating engine including a pair of pistons P1 and P2 in cylinders C1 and C2. The pistons are attached to connecting rods extending to crank shaft 44, carrying a flywheel 45 and having an output shaft 46 for coupling the engine to a suitable load.

The admission of pressurized vapor from line 39 into the cylinders C1 and C2 is controlled by the respective solenoid-operated intake valves 48 and 49, leading from the line 40 to the intake ports of the respective cylinders. In a similar fashion, the exhaust ports of the cylinders C1 and C2 are selectively connected to the low pressure vapor line 41 by the solenoid-controlled exhaust valves 50 and 51. The normally-closed intake valves 48 and 49 are controlled by the cam-actuated intake valve switches 48S and 49S, which in turn are actuated by the intake cams 48C and 49C mounted on the cam shaft 52 coupled to the crank shaft 44. The normally-closed exhaust valves 50 and 51 likewise are controlled by the exhaust valve switches 50S and 51S actuated by the cams 50C and 51C mounted on the cam shaft 52. The profile and angular placement of the intake and exhaust cams on the cam shaft are chosen in a manner known to those skilled in the art to introduce pressurized vapor to the respective cylinders at the appropriate time, for example, when the piston P is approaching or at top dead center in the cylinder, and to open the exhaust valve at the appropriate time for expanded vapor to be exhausted from the cylinder during the next compression stroke of the piston. It will be obvious to those skilled in the art that the intake and exhaust valves alternatively can be mechanically actuated by direct contact with the cam shaft, and that other valving techniques may be utilized. It should also be understood that the use of a reciprocating engine for the utilization apparatus 11 is by way of example only, and that other kinds of gas expansion engines such as turbines or the like may be substituted.

The expanded vapor exhausted from the utilization apparatus 11 travels through the line 41 to the condenser 12, where the vapor becomes at least partially liquified. The check valves 53-1 and 53-2 in the lines leading from the exhaust valves 50 and 51 to the line 41 prevent reverse fluid flow from the condenser 12. The liquified working fluid in the condenser 12 is now at a relatively low pressure, and flows from the condenser through the liquid line 56 to enter the liquid return tank 13. The pressure of uncondensed vapor entering the condenser 12 is sufficient to elevate the liquified working fluid from the bottom of the condenser 12 to the return tank 13 located above the condenser, although the return tank alternatively can be positioned below the condenser to provide a gravity-assisted flow of condensed working liquid. A check valve 57 in the line 56 assures a one-way flow of liquid in that line. A metering valve 58 may also be placed in the liquid return line 56 to regulate the flow of liquified working fluid to the return tank 13.

The return tank 13 preferably is elevated above the recovery vessels 27A and 27B. The liquid return line 60 extends downwardly from the return tank 13, splits at the branch 61, and travels by way of return solenoid valves 62A and 62B to enter the respective recovery vessels 27A and 27B. Also extending from each recovery vessel to the return tank 13 is the vapor pressure equilizer line 63, connected to the return tank at a location above the anticipated maximum liquid level within that tank. The equalizer line 63 is selectably connected to either recovery vessel 27A or 27B by opening the normally-closed solenoid valve 64A or 64B in the equalizer line.

Another vapor return line 67 extends from the return tank 13 to the inlet side of the utilization apparatus 11. The return line 67 branches to the return lines 67-1 and 67-2, each containing a check valve blocking reverse flow back to the return tank 13 and each connected to the input sides of the respective cylinders C1 and C2 downstream of the intake valves 48 and 49 associated with those cylinders. Another line 68 branches off the vapor return line 67 through a similar check valve, and terminates at the venturi outlet 69 located in the line 40 leading to the intake valves for the utilization apparatus 11. The vapor return line 67 and associated apparatus is optional, and the function of this apparatus is described below in greater detail.

The operation of the present apparatus is now described. The working fluid system is assumed to be charged with a supply of working fluid having a boiling point suitable to be boiled and vaporized by heat available from the heat collector 10. One such working fluid is monochlorodifluoro methane, with a boiling point of −41.6° F. It is also assumed that the generator 26 contains a quantity of working fluid substantially in the liquid state at this time, and that the recovery solenoid valve 28A interconnecting the generator 26A and the recovery vessel 27A is closed. Furthermore, the solenoid valve 71A in the pressure equalizing line 72A interconnecting the recovery vessel and generator is closed.

The transfer solenoid valve 33A is opened while the transfer valve 33B to the generator 26B remains closed at this time, allowing the heated transfer liquid to flow through the heat exchange coil 31A associated with the generator 26A. The working fluid within the generator 26A becomes vaporized by the heat introduced to the generator, causing a buildup of pressurized vapor within the generator. This pressurized vapor flows from the generator 26A through the vapor supply line 37A and check valve 38A and the line 40 to the utilization apparatus 11, where the pressurized vapor is expanded in the course of performing useful work output. Vapor pressure within the line 39 is monitored by the pressure gauge 73, and the check valve 38B prevents pressurized vapor from backing up into the generator 26B.

Expanded and therefore relatively low-pressure vapor exhausted from the utilization apparatus 11 travels via the vapor line 41 to enter the condenser 12, where the working fluid is at least partially reliquified. The working fluid now flows through the line 56 to the return tank 13, where the liquid or liquid-vapor mixture is collected. Working fluid vapor within the return tank 13 may be withdrawn from that tank through the vapor return line 67, in response to the relatively low pressure created by the venturi 69 and/or the engine cylinders during the intake cycle. This withdrawal of vapor from the return tank promotes boiling of liquid within the tank, and thereby further reduces the temperature of the working fluid returned to the working fluid units A or B.

The liquified working fluid is now returned to the recovery vessel 27A associated with the generator 26A presently supplying high pressure vaporized working fluid to the utilization apparatus 11. This return of liquified working fluid is accomplished by opening solenoid valve 62A in the return line 60, leading to the recovery vessel 27A, and at the same time equalizing the vapor pressure between this recovery vessel and the return tank 13 by opening the solenoid valve 64A in the pressure equalizer line 63. Liquified working fluid flows by gravity from the return tank 13 to the recovery vessel 27A at this time. When the recovery vessel 27A receives a desired fill of working fluid, the solenoid valves 62A and 64A are closed. At this time the recovery solenoid valve 28A is opened, allowing the collected working liquid to descend from the recovery vessel 27A to the generator 26. The solenoid valve 71A in the equalizer line **72*a* between the generator and recovery vessel also is opened at this time, to equalize vapor pressure between generator and recovery vessel. The generator 26A may receive the collected working liquid at a slower rate than the liquid is being vaporized. The solenoid valves 28A and 72A are returned to closed position when the transfer of working fluid to the generator 26A** is completed.

The second generator 26B is assumed to be charged with working fluid, and is ready to commence producing vaporized working liquid for operating the utilization apparatus 11. This is accomplished by opening the transfer solenoid valve 33B, allowing heated transfer liquid from the heat collector 10 to flow through the heat exchange coil 31B associated with the generator 26B. The transfer valve 33B may be opened concurrently with the transfer valve 33A supplying heated transfer liquid to the generator 26A, or the two transfer valves may operate in mutually-exclusive fashion so that the flow of heated transfer liquid is switched completely from the generator 26A to the generator 26B. In either case, the second generator 26B may now commence supplying pressurized working fluid through the line 37B and check valve 38B to the utilization apparatus 11. There are no switched control valves in the vapor supply lines 37A and 37B The transition between generators 26A and 26B as a source of vapor pressure occurs smoothly and gradually even as the transfer liquid is switched from the generator 26A to generator 26B.

After the transfer valve 33A is closed and the transition from working fluid unit A to unit B is completed, the recovery vessel 27B now becomes available to receive liquified working fluid collected in the return tank 13. This return of working fluid takes place in a manner similar to that described above, with solenoid valves 62B and 64B being opened to establish a gravity liquid flow path and a vapor pressure equalization path, respectively, from the return tank 13 to the recovery vessel 27B. Meanwhile, condensed working fluid in the recovery vessel 27A can flow into the generator 26A as the valve 28A is reopened, so as to recharge the generator 28A for the next operating cycle. Other operating aspects of the present system remain as described above, and the generator 26B continues to supply pressurized working fluid vapor to the utilization apparatus 11 until the first generator 26A once again receives a quantity of working fluid and is again subjected to heat from the collector 10. Another operating cycle of the present apparatus then is underway.

It can be seen that the present apparatus continues operating as long as the heat collector 10 is subjected to heat sufficient temperature to boil and vaporize the selected working fluid. A minimum temperature differential of approximately 30° F. is observed to be appropriate for such operation including vaporization and recondensation, in the case of a specific embodiment using the working fluid as previously identified. The present system requires no compressor to reliquify the working fluid, inasmuch as plural separate working fluid units leave at least one such unit off-line to recover the liquified working fluid and return that fluid to a generator, while at least one other working fluid unit is currently on-line utilizing heat energy to boil the working fluid and supply vapor to the utilization apparatus.

It should be under that the foregoing relates only to a preferred embodiment of the present invention, and that numerous changes and modifications may be made therein without departing from the spirit or scope of the invention as set forth in the following claims.

I claim:

1. Heat powered vapor generating apparatus, comprising:

first and second working fluid units receiving a quantity of a vaporizable working fluid;

each of said units comprising a vapor generator selectably receiving heat to vaporize liquified working fluid in the vapor generator, and a fluid recovery vessel in elevated relation to said vapor generator;

fluid lines connected to said vapor generators and conducting vaporized working fluid at a high pressure to a utilization means which expands the vapor and thereafter exhausts the expanded vapor at a relatively lower pressure;

condensing means operative to receive and condense said exhaust vapor;

working fluid return means operatively associated with said condensing means and with both of said recovery vessels and operative to return condensed working fluid to a selected recovery vessel;

each of said working fluid units further comprising a fluid line in communication with liquid working fluid collected in the recovery vessel and extending to the vapor generator, and a fluid recovery valve selectably opening said fluid line to allow said liquid working fluid collected in the elevated recovery vessel to drain into the vapor generator; and each of said working fluid units further comprising a pressure equalizing line in communication between the vapor generator and the recovery vessel above the level of collected liquid therein, and an equalizing valve selectably operative to open said equalizing line when said fluid recovery valve is open, so as to equalize vapor pressure between vapor generator and recovery vessel of a selected working fluid unit as liquid working fluid collected in the recovery vessel is drained to the vapor generator.

2. Apparatus as in claim 1, further comprising:

means selectably heating said vapor generators in alternating sequence allowing one working fluid unit to collect a quantity of condensed working fluid while a selected working fluid unit supplies the vaporized working fluid to the utilization means; and one-way valve means associated with said fluid lines connected to each vapor generator and conducting the vaporized working fluid to the utilization means, whereby vaporized working fluid is through said one-way valve means supplied to the utilization means from either or both of the vapor generators, depending on vapor pressure in the respective said fluid lines, without requiring an abrupt switching transition between the vapor generators.

3. Apparatus as in claim 2, wherein said one-way valve means comprises a first one-way valve in the fluid line conducting vaporized working fluid from one said vapor generator to said utilization means, and a second one-way valve means in the fluid line conducting vaporized working fluid from the other said vapor generator to the utilization means.

4. Apparatus as in claim 1, wherein said working fluid return means comprises:

a collection vessel connected to receive working fluid from said condensing means, so that said collection vessel may contain a mixture of liquified and vaporized working fluid;

liquid return lines in communication with the liquified working fluid in said collecting vessel and extending to each of said recovery vessels, including liquid return valve means selectively operative to control liquid flow to a selected recovery vessel; and second vapor pressure equalizing lines in communication with the vaporized working fluid in said collecting vessel and extending to each recovery vessel above the level of liquid collected therein, including valve means selectably operative to equalize the vapor pressure between said collecting vessel and said selected recovery vessel as said liquid return valve means is opened to permit liquid working fluid to return to said selected recovery vessel.

5. Apparatus as in claim 4, further comprising:

a vapor supply line in communication with the vaporized working fluid in said collecting vessel and conducting vapor to said utilization means for utilization therein.

6. Heat powered apparatus, comprising:

first vapor generating means for selectably receiving a quantity of vaporizable working fluid;

first recovery vessel operatively associated with said first vapor generating means for selectably collecting a quantity of working fluid;

second vapor generating means for selectably receiving a quantity of vaporizable working fluid;

second recovery vessel operatively associated with said second vapor generating means for selectably collecitng a quantity of working fluid;

means selectably operative to direct heat to either said first or second vapor generating means and to the working fluid in the selected vapor generating means, so as to increase the pressure of the working fluid;

utilization means connected to receive vaporized working fluid at a first pressure from either vapor generating means and operative to produce work by expanding the vaporized working fluid, and thereafter exhausting the vapor at a second pressure lower than said first pressure;

condenser means operative to receive and condense said exhaust vapor;

means selectably operative to return said condensed working fluid to the recovery vessel not associated with the vapor generating means currently supplying vapor to said utilization means;

return means connected to receive and collect condensed working fluid from said condenser means;

a first valved fluid line selectably operable to conduct said collected working fluid from said return means to said first recovery vessel;

a second valved fluid line selectably operable to conduct said collected working fluid from said return means to said second recovery vessel; and vent line means selectably operative to establish pressure equalization between said return means and the recovery vessel selected to receive said collected working fluid, so that the collected working can flow to the selected recovery vessel without pressure differential opposition.

7. Apparatus as in claim 6, further comprising:

a first vapor supply line including a one-way valve means for conducting vapor from said first vapor generating means to said utilization means; and a second vapor supply line including a one-way valve means for conducting vapor from said second vapor generating means to said utilization means;

whereby the utilization means receives vapor from either or both of said vapor generating means through said one-way valves.

8. Apparatus as in claim 6, wherein said means for directing the source of heat comprises:

a closed system containing a transfer liquid and selectably connectable to individual heat exchange means respectively associated with said first and vapor generating means; and means operative to recirculate said transfer liquid between said heat source and the selected vapor generating means from the operatively associated recovery vessel.

* * * * *